US009019065B2

(12) United States Patent
Gianesello

(10) Patent No.: US 9,019,065 B2
(45) Date of Patent: Apr. 28, 2015

(54) INTEGRATED INDUCTIVE DEVICE

(75) Inventor: Frederic Gianesello, Crolles (FR)

(73) Assignee: STMicroelectronics SA, Montrouge (FR)

( * ) Notice: Subject to any disclaimer, the term of this patent is extended or adjusted under 35 U.S.C. 154(b) by 715 days.

(21) Appl. No.: 12/876,595

(22) Filed: Sep. 7, 2010

(65) Prior Publication Data

US 2011/0057759 A1 Mar. 10, 2011

(30) Foreign Application Priority Data

Sep. 8, 2009 (FR) ..... 09 56100

(51) Int. Cl.

| | |
|---|---|
| ***H01F 27/28*** | (2006.01) |
| ***H01F 5/00*** | (2006.01) |
| ***H01F 17/00*** | (2006.01) |
| ***H01F 27/34*** | (2006.01) |

(52) U.S. Cl.

CPC ..... *H01F 17/0006* (2013.01); *H01F 27/346* (2013.01); *H01F 2017/0073* (2013.01); *H01F 2017/0086* (2013.01)

(58) Field of Classification Search

USPC ..... 336/200, 225, 226, 232

See application file for complete search history.

(56) References Cited

U.S. PATENT DOCUMENTS

| | | | | |
|---|---|---|---|---|
| 1,604,478 | A * | 10/1926 | Orton | 336/208 |
| 6,060,976 | A * | 5/2000 | Yamaguchi et al. | 336/200 |
| 2004/0140878 | A1 | 7/2004 | Heima | |
| 2005/0068146 | A1 * | 3/2005 | Jessie | 336/200 |
| 2005/0140486 | A1 | 6/2005 | Lin | |
| 2005/0195063 | A1 | 9/2005 | Mattsson | |
| 2006/0033602 | A1 * | 2/2006 | Mattsson | 336/200 |
| 2006/0220778 | A1 * | 10/2006 | Marques | 336/225 |

FOREIGN PATENT DOCUMENTS

WO WO 2009/081342 A1 7/2009

OTHER PUBLICATIONS

Neihart, N.M., et al., "Twisted Inductors for Low Coupling Mixed-Signal and RF Applications," IEEE Custom Integrated Circuits Conference, Sep. 21-24, 2008, pp. 575-578.

* cited by examiner

*Primary Examiner* — Tsz Chan

(74) *Attorney, Agent, or Firm* — Slater & Matsil, L.L.P.

(57) ABSTRACT

Integrated inductive device comprising a central loop arranged between two outer loops mutually coupled to the central loop so as to form two patterns roughly in the form of an eight having a common portion corresponding to said central loop.

20 Claims, 4 Drawing Sheets

INTEGRATED INDUCTIVE DEVICE

This application claims priority to French Patent Application No. 09-56100, which was filed Sep. 8, 2009 and is incorporated herein by reference.

TECHNICAL FIELD

The invention relates to integrated circuits, notably integrated inductive devices, and in particular those produced in the voltage-controlled oscillators of wireless communication appliances.

BACKGROUND

Currently, integrated inductive devices in electronic circuits comprise a plurality of coils, called "loops," which loops induce electromagnetic fields in areas adjacent to the inductive device. The loops further disrupt the operation of components that are situated in close proximity to the inductive device, however. Further, the inductive devices must be integrated in circuits that are increasingly miniaturized. It is therefore advantageous to devise inductive devices which have a surface area that is small enough to be easily integrated in said electronic circuits.

Moreover, there is an interest in providing inductive devices that have a sufficiently high inductance and that generate the weakest possible electromagnetic fields in order to reduce the electromagnetic disturbances in the vicinity of the inductive device.

U.S. Patent Application Publication No. US2005/0195063 describes an integrated inductive device comprising two coplanar loops that are mutually coupled so as to roughly form an eight with a top loop and a bottom loop, said loops being roughly symmetrical relative to a horizontal axis of the inductance. However, this inductive device includes dissymmetry that causes a non-uniformity of the electromagnetic fields induced in the vicinity of the inductive device. Also, this inductive device does not make it possible to adequately reduce the induced electromagnetic fields.

SUMMARY OF THE INVENTION

There is therefore proposed, according to one embodiment, an integrated inductive device that makes it possible to reduce the levels of coupling with the environment, that is to say reduce the electromagnetic fields induced in the vicinity of this inductive device, while retaining a small surface area for the integrated inductive device concerned.

According to one aspect, there is proposed an integrated inductive device comprising a central loop arranged between two outer loops mutually coupled to the central loop, so as to form two patterns roughly in the form of an eight having a common portion corresponding to said central loop.

This device makes it possible to reduce the levels of coupling with the environment, notably thanks to the central loop which generates an induced electromagnetic field opposing the electromagnetic fields induced by the two outer loops. Such a device also makes it possible to obtain a sufficiently small outer diameter, this outer diameter being, for example, between 150 and 400 micrometers.

Advantageously, the central loop is fully inserted between the outer loops.

This arrangement of the loops makes it possible to improve the uniformity of the induced electromagnetic field generated in the areas adjacent to the inductive device. Thus, the creation of a significant induced electromagnetic field in a favored area adjacent to the inductive device is prevented.

The device can also comprise an axis of symmetry situated in the plane of the device.

This makes it possible to provide an inductive device that is substantially perfectly symmetrical (to within manufacturing tolerances) relative to an axis of the device, which improves the uniformity of the electromagnetic field induced at the periphery of this device. Moreover, an inductive device which presents a substantially perfect symmetry makes it possible to simplify its manufacture and favor its integration in an electronic circuit.

According to one embodiment, the device comprises an additional axis situated in the plane of the device and perpendicular to said axis of symmetry of the device, each outer loop being substantially symmetrical relative to the additional axis.

According to yet another embodiment, the central loop is open and symmetrical relative to said axis of symmetry and the device comprises two power supply means connected to the central loop in the vicinity of its opening.

An opening formed at the level of the central loop makes it possible to free access to the mid-point of the inductive device.

Furthermore, the central loop can be facing all the outer loops.

The three loops of the inductance preferably have roughly the same outer diameter, which, on the one hand, favors the uniformity of the induced electromagnetic field and, on the other hand, improves the reduction of the coupling levels.

According to another aspect, there is proposed an integrated circuit comprising an integrated inductive device as defined previously.

According to yet another aspect, there is proposed a voltage-controlled oscillator comprising an integrated circuit provided with an integrated inductive device as defined previously.

According to yet another aspect, there is proposed a wireless communication appliance comprising a voltage-controlled oscillator as defined hereinabove.

It is thus possible, notably, to provide an inductive device integrated in a voltage-controlled oscillator in order to reduce the induced electromagnetic fields originating, for example, from a power amplifier situated in the vicinity of the voltage-controlled oscillator and that are likely to disrupt the operation of the voltage-controlled oscillator. Such an integrated inductive device makes it possible to improve the output signal delivered by the voltage-controlled oscillator when the latter is placed in an environment with strong electromagnetic disturbances.

BRIEF DESCRIPTION OF THE DRAWINGS

Other benefits and features will become apparent from studying the detailed description of embodiments of the invention, which are by no means limiting, and the appended drawings in which.

DETAILED DESCRIPTION OF ILLUSTRATIVE EMBODIMENTS

Figure 1:
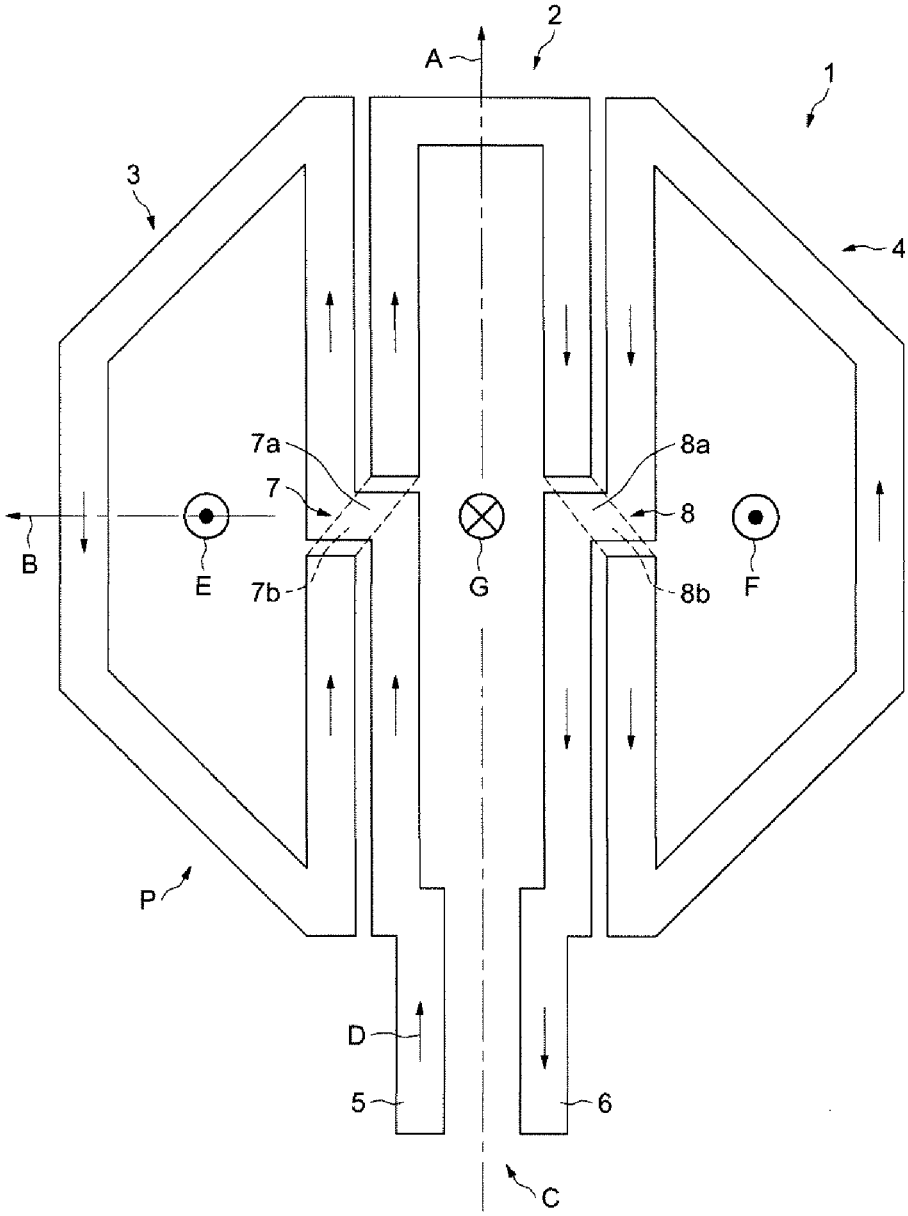
FIG. 1 illustrates one embodiment of an integrated inductive device.

FIG. 1 diagrammatically shows one embodiment of an integrated inductive device 1 intended for integration in an integrated circuit. The integrated inductive device comprises a central loop 2 and two outer loops 3, 4. The inductive device 1 also comprises an axis of symmetry A and an additional axis B which is perpendicular to said axis of symmetry A.

The central loop 2 comprises an opening C, situated in the axis of the axis of symmetry A of the inductive device 1, in order to be able to power the latter. The inductive device 1 also comprises two power supply means 5, 6, connected to the central loop 2 and in the vicinity of its opening C. The central loop 2, and the outer loops 3, 4, are coplanar, on a plane P of the integrated inductive device 1. The axis of symmetry A and the additional axis B are also coplanar to said loops 2 to 4.

The integrated inductive device 1 comprises at least two metallization levels (a top level and a bottom level) separated by a dielectric. FIG. 1 shows the top metallization level of the inductive device 1 represented by solid lines and the bottom level represented by broken lines.

The two outer loops 3, 4 are mutually coupled to the central loop 2 so as to form two patterns roughly in the form of an eight, having a common portion corresponding to said central loop 2. The first outer loop 3 is mutually coupled to the central loop 2 by a first link 7. The second outer loop 4 is also mutually coupled to the central loop 2 via a second link 8. The first link 7 includes a portion 7*a* on the top metallization level and a portion 7*b* on the bottom metallization level, the portion 7*b* being linked to the top metallization level by vias (not represented here for the purpose of simplification). The second link 8 includes a portion 8*a* on the top metallization level and a portion 8*b* on the bottom metallization level, the portion 8*b* being linked to the top metallization level by vias (not represented here for the purposes of simplification).

FIG. 1 also shows the direction of the path D of the current passing through the inductive device 1. The power supply current of the inductive device 1 enters via the first power supply means 5 and leaves via the second power supply means 6.

Furthermore, the power supply current passes through the outer loops 3, 4 in the anticlockwise direction. The current thus generates in the first outer loop 3 a first induced electromagnetic field on a first axis of direction E which is perpendicular to the plane P of the inductive device 1 and oriented in a first direction. Similarly, the current also generates in the second outer loop 4 a second induced electromagnetic field on a second axis of direction F which is also perpendicular to the plane P of the inductive device 1 and oriented in the same first direction as the first axis of direction E.

The power supply current passes through the central loop 2 in the clockwise direction, and thus generates a third induced electromagnetic field on a third axis of direction G which is perpendicular to the plane P of the inductive device 1 and oriented in a second direction opposite to the first direction of the axes of direction E, F of the outer loops 3, 4. This third induced electromagnetic field makes it possible to compensate the two first electromagnetic fields, thus making it possible to reduce the levels of coupling between the inductive device 1 and the components of the integrated circuit situated in the vicinity of the latter.

It will be noted that the third axis of direction G is situated roughly at the mid-point of the inductive device 1 and that this mid-point can be accessed from the opening C of the central loop 2. It will also be noted that the outer loops 3, 4 each comprise a mid-point and that the two axes of direction E, F respectively pass through said mid-points of the outer loops 3, 4.

Moreover, the central loop 2 is fully inserted between the outer loops 3, 4 so that the mid-points of the outer loops 3, 4 are aligned with the mid-point of the inductive device. This means that the three mid-points are aligned on the additional axis B, which favors the uniformity of the overall electromagnetic field induced by the inductive device 1. Furthermore, the central loop 2 is facing all the outer loops so that the three loops 2, 3, and 4 have substantially the same diameter.

Figure 2:
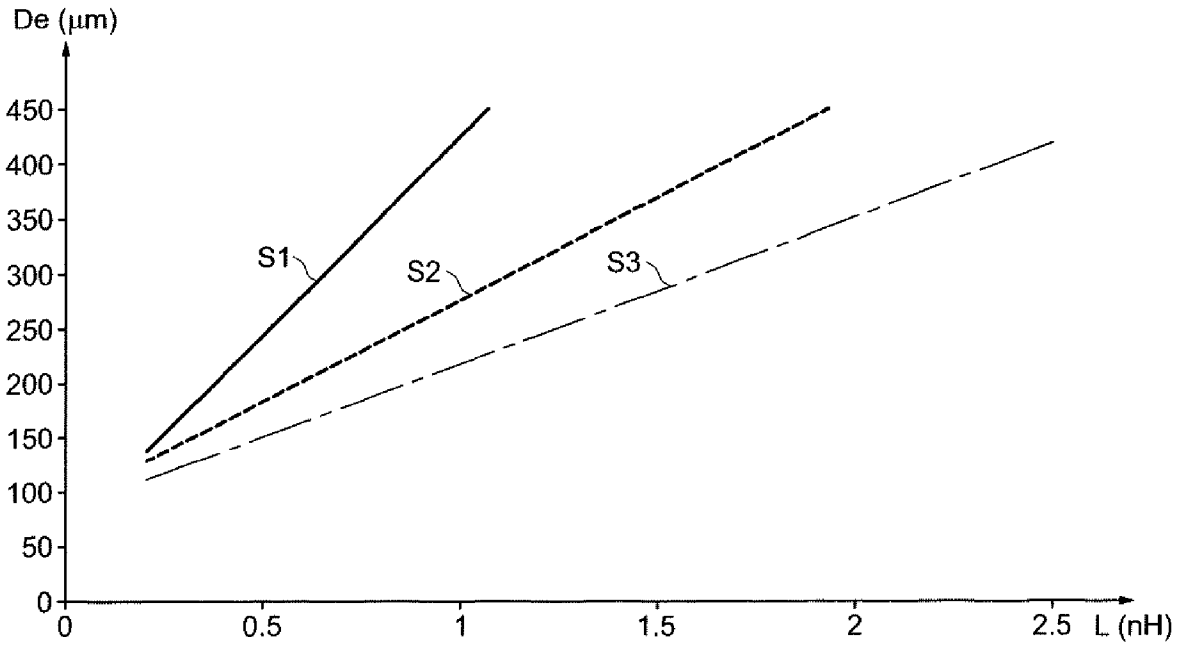
FIG. 2 illustrates the inductance curves of different integrated inductive devices.

FIG. 2 shows, by way of comparison, three curves S1, S2, S3 of inductance as a function of the outer diameter De of the integrated inductive device 1. The first curve S1 is obtained from an integrated inductive device comprising a single loop. The second curve S2 is obtained from an integrated inductive device comprising two loops as described in U.S. Patent Application Publication No. US2005/0195063. The third curve S3 is obtained from an integrated inductive device 1 comprising three loops as described in FIG. 1.

The x-axis corresponds to the inductance L of an integrated inductive device expressed in nanohenries. The y-axis corresponds to the diameter De of the integrated inductive device expressed in micrometers. A comparison of the three curves reveals the increase in the inductance L, for one and the same diameter De, of the integrated inductive device 1 as described in FIG. 1, compared to the state of the art represented by the two first curves S1, S2.

Figure 3:
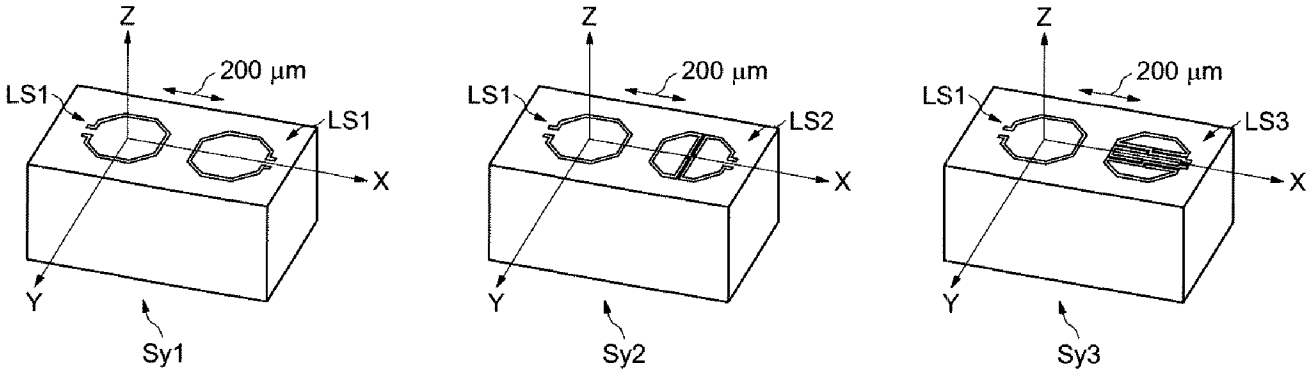
FIGS. 3 and 4 illustrate the coupling levels of three integrated inductive devices.

FIG. 3 diagrammatically shows three systems Sy1, Sy2, Sy3 each comprising a first reference inductive device LS1 and a second inductive device that is different for each system Sy1, Sy2, Sy3, in order to measure the level of coupling between each second inductive device and the reference inductive device LS1, in order to compare the level of coupling generated by each of the different inductive devices. The reference inductive device LS1 comprises a single loop.

The first system Sy1 comprises the first reference inductive device LS1 situated at a distance of 200 micrometers from a second inductive device LS1 that is identical to the first.

The second system Sy2 comprises the reference inductive device LS1 situated at the distance of 200 micrometers from a second inductive device LS2 comprising two loops as described in U.S. Patent Application Publication No. US2005/0195063.

The third system Sy3 comprises the reference inductive device LS1 situated at a distance of 200 micrometers from a second inductive device LS3 comprising three loops as described in FIG. 1.

Figure 4:
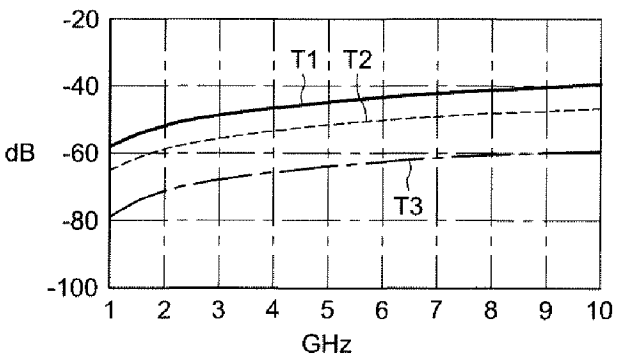

FIG. 4 shows, by way of comparison, three coupling level measurement curves T1, T2, T3 respectively from the three systems Sy1, Sy2, Sy3 described in the preceding FIG. 3. The coupling levels are expressed in decibels as a function of the frequency (in gigahertz) of the current that passes through the inductive devices. It will be noted that the decibel unit (denoted dB) is a logarithmic unit measuring the ratio between two powers. This unit is dimensionless and defines a scale of intensity known to those skilled in the art.

A comparison of the three curves shows the reduction of the coupling level of the inductive device LS3, as described in FIG. 1, compared to the state of the art represented by the two inductive devices LS1 and LS2. Thus, it can be noted that the inductive device LS3 makes it possible to improve the coupling by approximately 15 dB compared to the inductive device LS2 as described in U.S. Patent Application Publication No. US2005/0195063.

Figure 5:
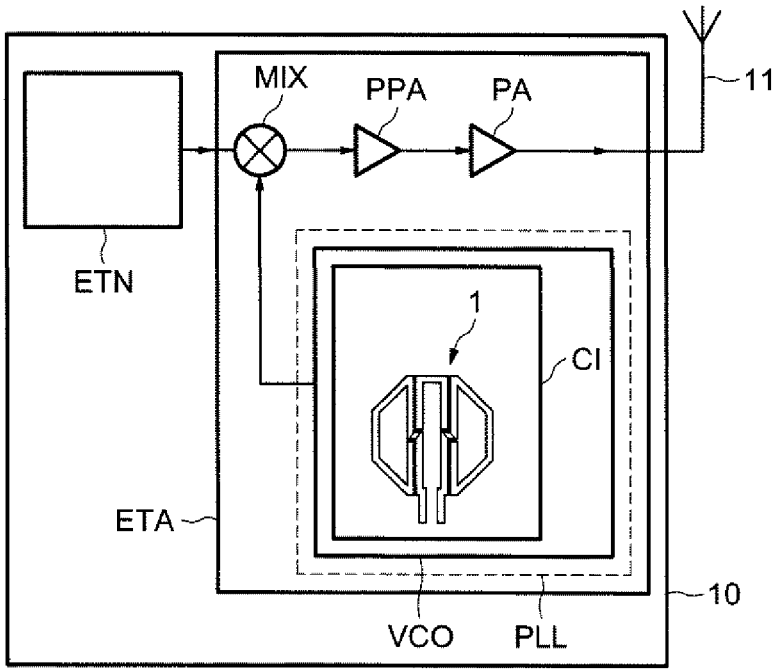
FIG. 5 illustrates a wireless communication appliance.

FIG. 5 diagrammatically shows a wireless communication appliance 10. This wireless communication appliance 10 comprises an antenna 11 for transmitting and receiving communication signals with a remote base station. This appliance comprises a transmission subsystem comprising, conventionally, a digital processing stage ETN, an analogue processing stage ETA and the antenna 11. The digital processing stage ETN generates a baseband signal intended for the analogue processing stage ETA.

The analogue processing stage ETA notably comprises a mixer MIX, a power preamplifier PPA, a power amplifier PA and a phase-locked loop PLL comprising a voltage-controlled oscillator VCO. The voltage-controlled oscillator VCO comprises an integrated circuit CI which includes at least one integrated inductive device 1 as described in FIG. 1. The output of the voltage-controlled oscillator VCO supplies a transposition signal for the mixer MIX.

The mixer MIX also receives the signal, in base band for example, from the digital processing stage ETN and frequency-transposes the baseband signal into a radiofrequency signal intended to be transmitted to the remote base station. This radiofrequency signal is amplified by an amplification subsystem comprising the power preamplifier PPA and the power amplifier PA, and then is transmitted using the antenna 11 of the appliance 10.

Thus, by employing an integrated inductive device 1, such as described herein, the coupling levels between the voltage-controlled oscillator VCO and, in particular, the power amplifier PA, are reduced, thus favoring the reduction of the spurious signals originating from the power amplifier PA and improving the output signal of the voltage-controlled oscillator VCO.

What is claimed is:

1. An integrated inductive device comprising:

a central loop, having an elongated axis aligned in a first direction, and being arranged between two outer loops, each outer loop having an elongated axis aligned in the first direction and being mutually coupled to the central loop so as to form two patterns, each pattern being substantially in the form of an eight and having a common portion corresponding to said central loop.

2. The integrated inductive device according to claim 1 wherein the central loop is fully inserted between the outer loops.

3. The integrated inductive device according to claim 1 further comprising a first axis of symmetry situated in the plane of the device.

4. The integrated inductive device according to claim 3 further comprising an additional axis situated in the plane of the device and perpendicular to said first axis of symmetry of the device, each outer loop being substantially symmetrical relative to the additional axis.

5. The integrated inductive device according to claim 3 wherein the central loop is open and symmetrical relative to said first axis of symmetry and the device comprises two power supply means connected to the central loop in the vicinity of its opening.

6. The integrated inductive device according to one of claim 1 wherein the central loop is facing all the outer loops.

7. The integrated inductive device according to claim 1 further comprising:

a substrate; and wherein the central loop and the outer loop are substantially planar conductors formed on the substrate.

8. The integrated inductive device according to claim 7 wherein the integrated inductive device is incorporated into a voltage controlled oscillator.

9. The integrated inductive device according to claim 8 wherein the voltage controlled oscillator in incorporated into a wireless communication appliance.

10. An integrated inductive device comprising:

a central loop having an elongated axis oriented in a first direction, and laying interjacent two outer loops; and each outer loop having an elongated axis oriented in the first direction, the outer loops being mutually coupled to the central loop so as to form two patterns, each pattern being substantially in the form of an eight and having a common portion corresponding to said central loop.

11. The integrated inductive device of claim 10 wherein the outer loops are configured such that a current flowing within both outer loops flows in a same direction, being one of clockwise and counter-clockwise.

12. The integrated inductive device of claim 10 wherein the central loop and the outer loops are substantially planar.

13. The integrated inductive device of claim 10 wherein a midpoint of the central loop is fully interposed between the outer loops.

14. The integrated inductive device of claim 13 wherein a midpoint of the first and the second outer loop is aligned with the midpoint of the central loop.

15. The integrated inductive device of claim 10 wherein the outer loops are symmetrical with respect to each other and asymmetrical with respect to the central loop.

16. The integrated inductive device of claim 10 wherein current flows in the central loop in a direction parallel to the elongated axis.

17. A wireless communication apparatus comprising:

an antenna configured to transmit and/or receive communication signals to/from a base station;

a digital processing stage configured to convert the communication signals to an analogue signal; and an analogue processing stage configured to process the analogue signal, and including a voltage controlled oscillator, the voltage controlled oscillator including an integrated inductive device comprising a substrate, a first outer loop and a second outer loop formed on the substrate;

a central loop formed on the substrate and arranged between the two outer loops;

wherein the outer loops are configured so that the central loop is mutually coupled to the outer loops when a current flows therethrough; and the outer loops being configured such that a current flowing within both outer loops flows in a same direction, being one of clockwise and counter-clockwise.

18. The wireless communication apparatus of claim 17 wherein an electric field generated within the outer loops counters an electric field generated within the central loop.

19. The wireless communication apparatus of claim 17 wherein each outer loop in combination with the central loop forms a figure eight pattern.

20. The wireless communication apparatus of claim 19 wherein each figure eight pattern has a common portion corresponding to the central loop.

* * * * *